US009050521B2

(12) United States Patent
Girard et al.

(10) Patent No.: US 9,050,521 B2
(45) Date of Patent: Jun. 9, 2015

(54) CROSS-COUNTRY SKI SYSTEM PROVIDED WITH A DIRECT BEARING LATERAL SURFACE

(75) Inventors: François Girard, Veyrier du Lac (FR); François Dufournet, Seynod (FR); Alois Pieber, Hohenzell (AT); Johann Hubinger, Taiskirchen (AT); Hannes Kogler, Vöcklabruchk (AT)

(73) Assignees: Salomon S.A.S., Metz Tessy (FR); FISCHER GESELLSCHAFT GMBH, Innkreis (AT)

( * ) Notice: Subject to any disclaimer, the term of this patent is extended or adjusted under 35 U.S.C. 154(b) by 1123 days.

(21) Appl. No.: 10/570,347

(22) PCT Filed: Sep. 1, 2004

(86) PCT No.: PCT/FR2004/002216

§ 371 (c)(1),
(2), (4) Date: Jun. 28, 2006

(87) PCT Pub. No.: WO2005/023384

PCT Pub. Date: Mar. 17, 2005

(65) Prior Publication Data

US 2007/0040357 A1 Feb. 22, 2007

(30) Foreign Application Priority Data

Sep. 3, 2003 (FR) ..... 03 10443

(51) Int. Cl.
*A63C 9/20* (2012.01)

(52) U.S. Cl.
CPC ..... *A63C 9/20* (2013.01)

(58) Field of Classification Search
USPC ..... 280/615, 632, 614, 613, 616, 633, 636, 280/809, 611, 609; 36/117.2
See application file for complete search history.

(56) References Cited

U.S. PATENT DOCUMENTS

| | | | | | |
|---|---|---|---|---|---|
| 2,172,669 | A | * | 9/1939 | Taft | 280/614 |
| 4,335,531 | A | * | 6/1982 | Salomon | 36/117.2 |
| 4,487,427 | A | | 12/1984 | Salomon | |
| 4,714,267 | A | * | 12/1987 | Abondance et al. | 280/615 |
| 4,789,177 | A | | 12/1988 | Graillat | |
| 4,836,572 | A | * | 6/1989 | Pozzobon | 280/613 |
| 4,842,293 | A | * | 6/1989 | Rochard | 280/615 |
| 4,887,832 | A | * | 12/1989 | Provence | 280/615 |
| 4,907,817 | A | | 3/1990 | Schwarz | |
| 4,913,455 | A | * | 4/1990 | Salsetti et al. | 280/615 |
| 4,945,658 | A | | 8/1990 | Provence | |
| 4,961,591 | A | * | 10/1990 | Bejean et al. | 280/607 |
| 5,011,179 | A | * | 4/1991 | Bejean et al. | 280/615 |
| 5,064,214 | A | * | 11/1991 | Diard et al. | 280/607 |

(Continued)

FOREIGN PATENT DOCUMENTS

| | | |
|---|---|---|
| EP | 0 878 218 A2 | 11/1998 |
| FR | 2 565 117 A1 | 12/1985 |

(Continued)

*Primary Examiner* — Katy M Ebner
(74) *Attorney, Agent, or Firm* — Greenblum & Bernstein P.L.C

(57) ABSTRACT

A cross-country ski includes a cross-country ski having a central area for receiving a ski binding device for fixing a ski boot to the ski. The fixing area includes a space for receiving the binding device and a top bearing surface of the ski which is applied to at least one side of the space for receiving the binding device and on which the boot is directly connectable when the user applies a pressure force.

40 Claims, 4 Drawing Sheets

(56) References Cited

U.S. PATENT DOCUMENTS

| | | | | |
|---|---|---|---|---|
| 5,085,454 | A * | 2/1992 | Provence et al. | 280/615 |
| 5,108,125 | A * | 4/1992 | Callegari | 280/615 |
| 5,333,890 | A * | 8/1994 | Bejean | 280/609 |
| 5,356,169 | A * | 10/1994 | Hue et al. | 280/607 |
| 5,664,797 | A * | 9/1997 | Haughlin | 280/615 |
| 6,017,050 | A | 1/2000 | Girard | |
| 6,213,493 | B1 * | 4/2001 | Korman | 280/613 |
| 6,257,620 | B1 * | 7/2001 | Kenney | 280/810 |
| 6,390,494 | B2 * | 5/2002 | Gignoux et al. | 280/615 |
| 6,499,761 | B1 | 12/2002 | Quellais | |
| 6,957,827 | B2 | 10/2005 | Kogler | |
| 6,986,526 | B2 | 1/2006 | Haughlin | |
| 2003/0193171 | A1 * | 10/2003 | Krumbeck et al. | 280/616 |
| 2007/0138765 | A1 | 6/2007 | Miette et al. | |
| 2007/0228695 | A1 | 10/2007 | Miette | |

FOREIGN PATENT DOCUMENTS

| | | | |
|---|---|---|---|
| FR | 2 739 788 | A1 | 4/1997 |
| FR | 2 742 060 | A1 | 6/1997 |
| FR | 2 782 652 | A1 | 3/2000 |
| WO | WO-01/93963 | A1 | 12/2001 |
| WO | WO-02/05907 | A2 | 1/2002 |
| WO | WO-02/49728 | A1 | 6/2002 |
| WO | WO-02/087710 | A1 | 11/2002 |

* cited by examiner 14
22
24
20
18
30
12
16
26
10
28

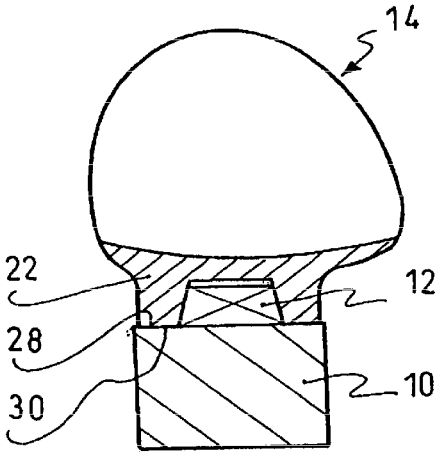
Fig: 2
Fig: 4
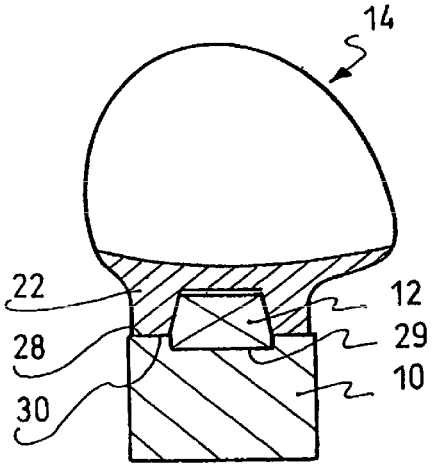

CROSS-COUNTRY SKI SYSTEM PROVIDED WITH A DIRECT BEARING LATERAL SURFACE

BACKGROUND OF THE INVENTION

1. Field of the Invention

The invention relates to the field of cross-country skiing.

2. Description of Background and Relevant Information

For a long time, cross-country skis had been used with rudimentary devices for binding the boot to the ski. The boot sole had, for example, a tongue or a binding strap extending beyond the front end of the boot and which was held in a lock arranged forward from the position of the boot in relation to the ski.

It has been realized that this type of binding has two major drawbacks. During the practice of the conventional alternate step technique, it has been noticed that these systems necessitated a forward rotational movement of the boot in relation to the ski about an axis which is located far ahead of the foot. The result is a movement of the foot that is not natural, far from the foot rolling movement that can be observed when walking. During the practice of the skating step, these systems also have the drawback of providing only a very poor lateral guidance of the boot in relation to the ski.

In order to remedy these problems, systems for binding the boot to the ski, whereby the boot waG is articulated on the ski about an axis arranged immediately behind the front end of the sole, were introduced in the 1980s. These systems have at least part of the binding device arranged under the boot sole. This enables the boot pivot point to be moved back in relation to the ski and to rigidify the torsional strength of the boot/binding assembly during the practice of the skating step.

The device described in the document FR-2.739.788 shows that the articulation axis of the boot as well as the elastic return means, which tend to apply the boot flat against the ski, are located under the sole.

Other devices, which are described, for example, in the documents FR-2.742.060, FR-2.782.652, WO-01/93963, WO-02/05907, or WO-02/087710, confirm that the trend is to seek a positioning of the binding device that is as much under the boot sole as possible, and no longer mainly at the front of the boot.

However, many of these systems have the drawback of being positioned between the boot and the ski, and of particularly raising the boot in relation to the ski. The primary consequence of this is not allowing for a direct support of the boot on the ski, which can negatively affect a proper support on the ski edges, especially for the practice of the skating step. In addition, in the known systems, the support of the boot on the ski does not occur directly on the ski, but rather generally by means of a baseplate which covers more or less the entire width of the ski upper surface, such as shown, for example, in the document EP-878.218. The presence of such a baseplate increases the height of the boot position and has a tendency to also distribute the pressure over the width of the ski whereas, during edge setting, one wishes instead to concentrate a maximum of the ski pressure on one of the edges, typically the inner edge.

SUMMARY OF THE INVENTION

An object of the invention is therefore to provide a cross-country ski which provides for better transmission of forces on the ski edges, as well as optimal stability.

To this end, the invention provides a cross-country ski having a binding zone adapted to receive a device for binding a boot to a ski, wherein the binding zone includes a location for receiving the binding device, and an upper support surface of the ski that is arranged on at least one side of the location for receiving the binding device and on which the boot can possibly come in direct contact when the user applies a pressure force.

BRIEF DESCRIPTION OF THE DRAWINGS

Other characteristics and advantages of the invention will appear from the detailed description that follows, with referenced to the annexed drawings, in which:

FIG. 2 is a cross-sectional schematic view of the cross-country ski system according to FIG. 1;

FIG. 4 is a transverse, cross-sectional schematic view of a cross-country system incorporating a ski having a shoulder;

DETAILED DESCRIPTION OF THE INVENTION

Figure 1:
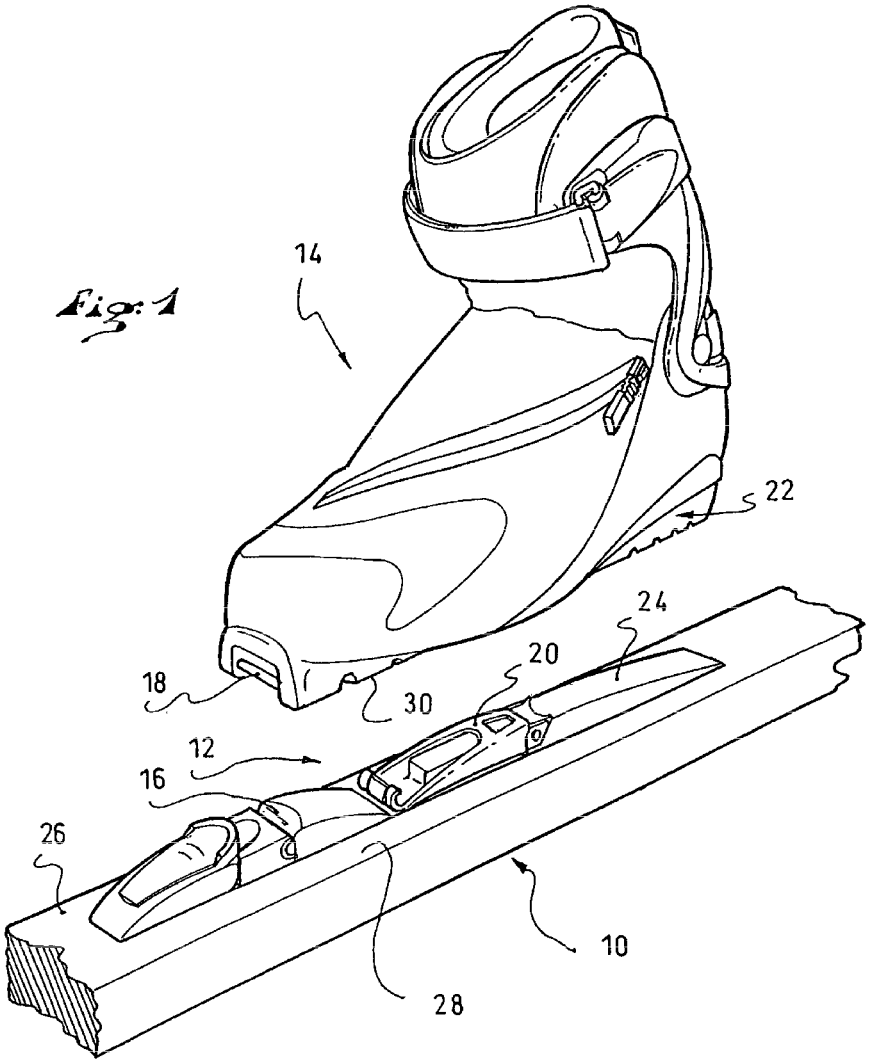
FIG. 1 is a partial, exploded perspective view of a cross-country ski system according to a first embodiment of the invention.

FIG. 1 shows a system for cross-country ski system including a ski 10, only a central zone of which is shown, the central zone being spaced from the ends of the ski. A device 12 for binding a cross-country ski boot 14 is mounted on this central zone of the ski. More specifically, the binding device 12 occupies, in this central zone, a location that corresponds to at least the size of the device viewed from above.

The binding device 12 is, for example, similar to that described in the document FR-2.739.788 and family member U.S. Pat. No. 6,017,050, which will be referred to for a detailed description. This device includes, in the illustrated embodiment, a connection mechanism, in the form of a front jaw 16 in which a transverse front bar 18 of the boot 14 is adapted to be locked to enable the attachment of the boot to the ski by means of articulation about the transverse axis of the bar. For this purpose, this binding device 12 enables the boot heel to be lifted from the ski. The device 12 also includes longitudinally, at the rear of the jaw 16, an elastic return mechanism that includes an articulated connecting rod 20 adapted, for example, to hook a rear bar (not shown) arranged under the sole 22 of the boot 14. Finally, in the rear extension of the connecting rod, i.e., rearward of the connecting rod, the binding device 12 also includes an upwardly projecting guiding edge 24, or rib, the profile of which is complementary to a corresponding downwardly facing groove (shown in cross section in FIG. 2) formed in the boot sole. As shown in FIG. 1, the rib 24 extends longitudinally rearward of the entirety of the mechanism that engages the boot to bind the boot to the ski, that is, rearward of the front bar and rear bar.

According to the invention, the arrangement of the binding device 12 on the ski 10 is such that, arranged transversely on both sides of the position of the binding device 12 are portions of the upper surface 26 of the ski that form support surfaces 28 which corresponding support surfaces 30 of the boot sole are adapted to contact directly. As can be seen in the drawings, the support surfaces extend to opposite transverse edges of the upper surface of the ski.

The invention encompasses several alternative embodiments.

FIGS. 1 and 2 show the case where the ski has an upper surface 26 that is essentially flat. In this case, the binding device 12 is arranged in a position that is transversely at the center of the ski. In this case, the location of the binding device 12, that is, the portion of the ski upper surface on which the binding device 12 is to be arranged, is located at the same height as the direct support lateral surfaces 28.

Figure 3:
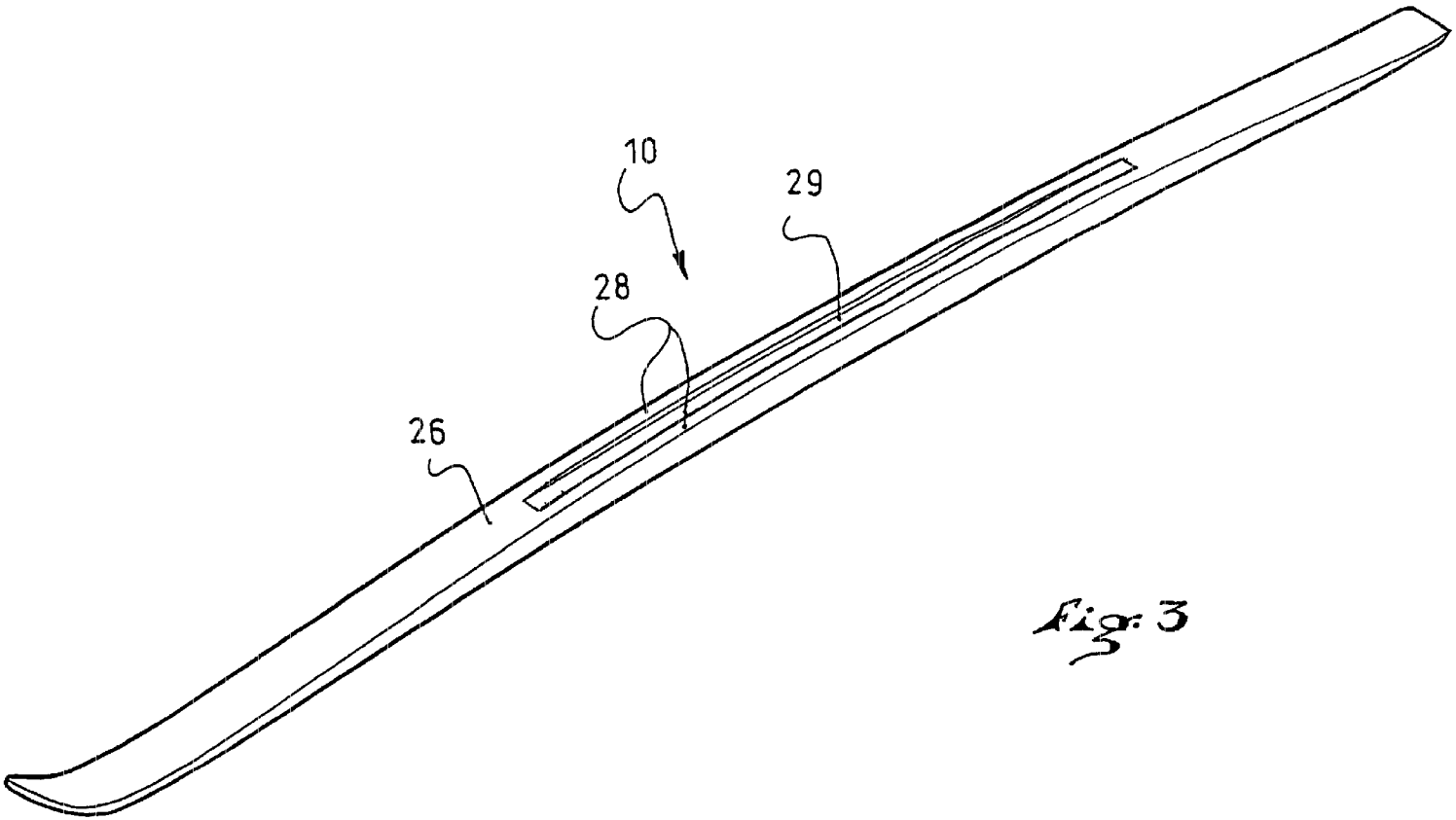
FIG. 3 is a perspective view of the cross-country ski alone, including lateral shoulders to carry out a second embodiment of the invention.

FIGS. 3 and 4 show an alternative embodiment in which the ski has, at least in its portion longitudinally located at the center, two lateral shoulders, which longitudinally extend on each side of the binding location 29, which is transversely located at the center of the ski. In this case, the upper surfaces of these shoulders advantageously form the direct support surfaces 28 in the context of the invention.

With respect to a ski having a planar, or flat, upper surface, the shoulders can be made in the form of elevated bosses, or they can result from an upwardly open recess in the central portion of the ski, this recess thus defining the location of the ski binding device. As can be seen in the cross section view of FIG. 4, the recess defining the binding location 29 is structured and arranged to receive the width of the binding 12 therein.

This embodiment allows achieving a lower position for the binding, and therefore a lower position of the boot with respect to the snow, which can favorably affect the stability of the system.

Contrary to the embodiment shown in FIG. 3, it can be provided that the lateral edges of the ski upper surface, on which the lateral support surfaces are formed, are arranged at a lower level than that of the binding device location. This results in a ski, the thickness of which is reduced on the lateral edges, thus reducing the height of the support surfaces in relation to the ski edges, while maintaining these support surfaces on both sides of the binding device.

In the example shown in FIG. 3, the difference in the level between the binding location and the two upper surfaces of the shoulders progressively varies so as to progressively disappear toward the front and rear ends of the shoulders (which therefore do not extend over the entire ski length). Conversely, for example in the case where binding location results in a longitudinally extending recess of the ski upper surface, the function of the front and rear ends of the recess with the ski upper surface can form a step.

In both cases, one can see in FIG. 2 and 4 that the support surfaces of the boot sole take support directly on the lateral surfaces 28, without having an intermediate element such as a plastic element between the two lateral surfaces. The transmission of the user's support forces, especially in the thrust phase, is thus made directly and is improved.

The binding device 12 shown in the drawings is a simple embodiment, and the invention can be implemented with other types of binding devices adapted for the practice of cross-country skiing. The invention also encompasses the binding device being partly integrated into the ski, for example with an element that is articulated directly in the ski, or with part of the guiding edge, or rib, integrated into the ski. However, the invention provides that, at least in the area of the support zone, the binding device is narrower than the ski. These support zones are preferably longitudinally arranged in an area corresponding to the metatarsophalangeal bending zone of the user's foot, which is the preferred zone through which the user exerts his support force at the end of the thrust, when his heel is already raised with respect to the ski.

Similarly, the examples show the case where two support surfaces are provided on respective sides of the binding. However, taking into account that the forces are mostly important on the side of the ski inner edge, during the practice of the skating step, one can provide that the ski include only one direct support lateral surface, arranged on only one side of the binding device.

Preferably, the lateral support surfaces 28 of the ski are substantially horizontal, meaning that they are substantially parallel to the lower gliding surface of the ski.

Figure 5:
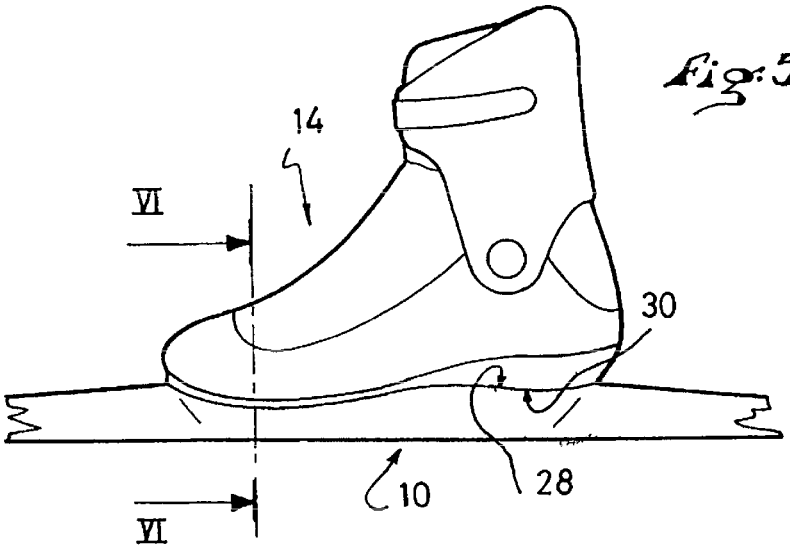
FIG. 5 is a side schematic view of an alternative embodiment of the invention.
Figure 6:
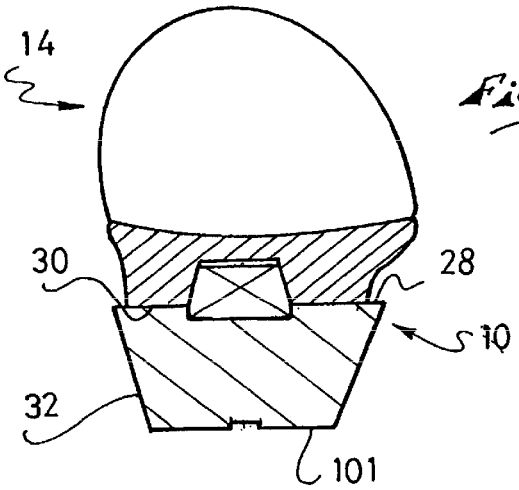
FIG. 6 is a transverse, cross-sectional schematic view along the line VI-VI of FIG. 5.
Figure 7:
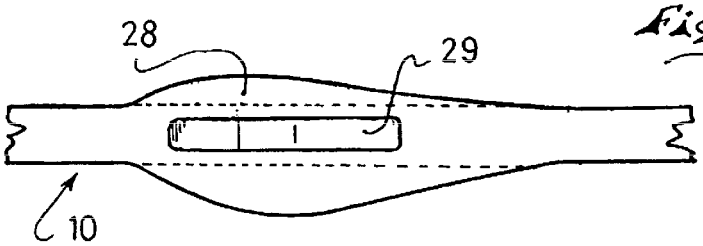
FIG. 7 is a schematic view of the upper surface of a ski as shown in FIGS. 5 and 6.

However, in the example of embodiment shown in FIGS. 5 to 7, it can be provided that the lateral support surfaces 28, instead of being flat or planar, have a curvature complementary to a curvature of the lower surface 30 of the boot sole.

Similarly, as can be seen in FIGS. 6 and 7, the lateral support surfaces 28 can be configured so that at least in the area of the support zone, the transverse width of the ski upper surface is greater than the width of the lower gliding surface of the ski through which the ski takes support on the snow. Such a construction, which results in the presence of oblique edges 32 on the ski, i.e., angled from perpendicular to the lower surface 101, shown greater than ninety degrees, makes it possible to increase edging. As can be seen, the importance of the lateral offset of the support surfaces 28 can be different on each side of the ski, which can thus have a dissymmetrical section. In addition, such a concept makes it also possible to rigidify the ski in torsion.

The invention claimed is:

1. A cross-country ski system comprising:

a cross-country ski comprising an upper surface including a central zone constructed and arranged to receive a device structured and arranged to be connected to a part of a boot in an area corresponding to a metatarsophalangeal bending zone of a wearer's foot for binding the boot to the ski;

the central zone of the ski comprising a binding zone having a location for receiving the binding device;

the upper surface of the ski comprising an upper support surface arranged on at least one of two lateral sides of the location to receive the binding device, the upper support surface being exposed laterally of the binding zone for coming in direct contact with the boot when a skier using the cross-country ski system exerts a pressure force with the boot toward the ski;

the location for receiving the binding device comprising an upwardly facing binding-receiving open recess of the upper surface of the ski;

the upwardly facing open recess of the upper surface of the ski extending downwardly at least partially to a depth below said upper support surface.

2. A cross-country ski system according to claim 1, wherein:

in the central zone of the ski, at least one lateral shoulder is arranged on one of the two lateral sides of the location for receiving the binding device such that the boot can be supported directly on the shoulder.

3. A cross-country ski system according to claim 2, wherein:

the shoulder comprises a support surface for the boot arranged above the upper surface of the location for receiving the binding device.

4. A cross-country ski system according to claim 1, wherein:

the ski comprises two lateral upper surfaces arranged on respective lateral sides of the location for receiving the binding device.

5. A cross-country ski system according to claim 1, wherein:

the upper support surface of the ski is longitudinally arranged in the area corresponding to a metatarsophalangeal bending zone of the wearer's foot.

6. A cross-country ski system according to claim 1, wherein:

at least in part of the central zone, a transverse width of the upper support surface is greater than a width of a lower gliding surface.

7. A cross-country ski system according to claim 1, wherein:

the upper support surface extends to an outer transverse edge of the upper surface of the ski.

8. A cross-country ski system according to claim 1, wherein:

the upwardly facing recess of the location for receiving the binding device extends within the area corresponding to the metatarsophalangeal bending zone of the wearer's foot.

9. A cross-country ski system according to claim 1, wherein:

the ski has no boot sole-engaging rib projecting from a longitudinal median plane of the ski.

10. A cross-country ski system according to claim 1, wherein:

the upwardly facing binding-receiving open recess is structured and arranged to receive a width of the binding device.

11. A cross-country ski system comprising:

a cross-country ski comprising a central zone adapted to receive a device for binding a boot to the ski;

the central zone of the ski comprising an upper surface including a binding zone having a location for receiving the binding device;

the upper surface of the ski comprising an upper support surface arranged on at least one of two lateral sides of the location to receive the binding device, the upper support surface being exposed laterally of the binding zone for coming in direct contact with the boot when a skier using the cross-country ski system exerts a pressure force;

the location for receiving the binding device comprising an upwardly facing open recess of the upper surface of the ski;

a binding device constructed and arranged to be fixed on the ski in the upwardly facing open recess of the location for receiving the binding device, the binding device including a mechanism for binding engagement with the boot;

the upwardly facing open recess of the upper surface of the ski extending downwardly at least partially to a depth below said upper support surface.

12. A cross-country ski system according to claim 11, wherein:

the binding device has, at least in the area of the support surface, a lesser width than a width of the ski.

13. A cross-country ski system according to claim 11, wherein:

the binding device is adapted to be fitted within the recess of the upper surface of the ski;

the binding device has an upwardly projecting rib adapted to be positioned within a downwardly facing longitudinal recess in a sole of the boot;

the cross-country ski system includes no baseplate to be mounted upon the ski between the boot and the upper support surface of the ski, so that the upper support surface of the ski is structured and arranged to contact the boot directly when the boot is engaged with the mechanism of the binding device.

14. A cross-country ski system according to claim 13, further comprising:

a boot having a support surface adapted to be supported directly by said upper support surface of the ski.

15. A cross-country ski system according to claim 14, wherein:

said support surface of the boot is in a metatarsophalangeal bending zone of the boot.

16. A cross-country ski system according to claim 11, wherein:

the mechanism for engagement with the boot includes a front jaw adapted to engage a front bar of the boot for enabling articulation of the boot with respect to the ski;

the binding device includes an elastic return mechanism, said elastic return mechanism being rearwardly spaced from the front jaw and being adapted to engage a rear bar of the boot for applying an elastic return force to the rear bar.

17. A cross-country ski system according to claim 11, wherein:

the binding device is adapted to be affixed to the ski by being positioned within the recess of the upper surface of the ski;

the binding device has an upwardly projecting rib adapted to be positioned within a downwardly facing longitudinal recess in a sole of the boot;

the cross-country ski system includes no baseplate that would prevent a lower external surface of the boot from direct supporting engagement on the upper support surface of the ski.

18. A cross-country ski system according to claim 11, wherein:

the binding zone has a length extending lengthwise of the ski;

continuously, at each lengthwise increment along an entirety of the length of the binding zone, the upper surface of the ski has a width greater than a width of the binding device.

19. A cross-country ski system according to claim 18, wherein:

with the binding device fixed to the ski in the binding zone, the lateral support surface is exposed for direct engagement of a lower surface of the boot during skiing.

20. A cross-country ski system according to claim 11, wherein:

the upper support surface extends to an outer transverse edge of the upper surface of the ski.

21. A cross-country ski system according to claim 11, wherein:

the upwardly facing recess of the location for receiving the binding device extends within an area corresponding to a metatarsophalangeal bending zone of the wearer's foot.

22. A cross-country ski system according to claim 11, wherein:

the ski has no boot sole-engaging rib projecting from a longitudinal median plane of the ski.

23. A cross-country ski system according to claim 22, wherein:

the binding device further comprises a boot sole-engaging rib rearward of an entirety of the mechanism for binding engagement with the boot.

24. A cross-country ski system according to claim 11, wherein:

the binding device further comprises a boot sole-engaging rib rearward of an entirety of the mechanism for binding engagement with the boot.

25. A cross-country ski system according to claim 11, wherein:

the upwardly facing open recess is structured and arranged to receive a width of the binding device.

26. A cross-country ski system comprising:

a cross-country ski and a binding device having a mechanism to engage a boot to bind the boot to the ski;

the cross-country ski having a longitudinally extending binding zone spaced from front and rear ends of the ski, said binding zone comprising:

a pair of transversely spaced apart longitudinally extending upper support surfaces structured and arranged to support directly support surfaces of a sole of a boot at least in a metatarsophalangeal bending zone of the boot when the boot is engaged with a mechanism of the binding device for engagement with the boot;

an upwardly open longitudinally extending binding-receiving recess positioned between said pair of upper support surfaces;

at least in the binding zone, the ski has an upper surface width greater than a width of the binding device, thereby exposing the upper support surfaces for direct contact with the sole of the boot on opposite lateral sides of the binding device;

the binding device being structured and arranged to be fixed upon the ski in the upwardly open recess of the binding zone, the binding device having an upwardly projecting rib adapted to be positioned within a downwardly facing longitudinally groove in the sole of the boot;

the upwardly facing open recess of the upper surface of the ski extending downwardly at least partially to a depth below said upper support surface.

27. A cross-country ski system according to claim 26, wherein:

the cross-country ski system includes no baseplate that would prevent a lower external surface of the boot from direct supporting engagement on the upper support surfaces of the ski.

28. A cross-country ski system according to claim 26, wherein:

the binding device includes a front jaw adapted to engage a front bar of the boot for enabling articulation of the boot with respect to the ski;

the binding device includes an elastic return mechanism, said elastic return mechanism being rearwardly spaced from the front jaw and being adapted to engage a rear bar of the boot for applying an elastic return force to the rear bar.

29. A cross-country ski system according to claim 28, further comprising:

a boot having support surfaces adapted to be supported directly by said upper support surfaces of the ski, said boot having said front and rear bars.

30. A cross-country ski system according to claim 26, wherein:

the upper support surface extends to an outer transverse edge of the upper surface of the ski.

31. A cross-country ski system according to claim 26, wherein:

the upwardly facing recess of the location for receiving the binding device extends within an area corresponding to a metatarsophalangeal bending zone of the wearer's foot.

32. A cross-country ski system according to claim 26, wherein:

the ski has no boot sole-engaging rib projecting from a longitudinal median plane of the ski.

33. A cross-country ski system according to claim 32, wherein:

the binding device further comprises a boot sole-engaging rib rearward of an entirety of the mechanism to engage the boot to bind the boot to the ski.

34. A cross-country ski system according to claim 26, wherein:

the binding device further comprises a boot sole-engaging rib rearward of an entirety of the mechanism for binding engagement with the boot.

35. A cross-country ski system according to claim 26, wherein:

the upwardly facing binding-receiving open recess is structured and arranged to receive a width of the binding device.

36. A cross-country ski system comprising:

a cross-country ski comprising an upper surface including a longitudinal central zone constructed and arranged to receive a binding device to be connected to a part of the boot in an area corresponding to a metatarsophalangeal bending zone of a wearer's foot for binding the boot to the ski;

the longitudinal central zone of the ski comprising a binding zone for receiving the binding device, said binding zone having a width less than a transverse width of the ski in the longitudinal central zone;

the longitudinal central zone of the ski further comprising at least one upwardly facing boot support surface extending laterally in a direction from said binding zone;

the location for receiving the binding device comprising a binding-receiving open interruption in the upper surface of the ski, said open interruption further extending downwardly at least partially to a depth below said upper surface of the ski.

37. A cross-country ski system according to claim 36, further comprising:

an upwardly projecting guide rib extending upwardly in the longitudinal central zone structured and arranged to engage with a downwardly facing longitudinal groove of the boot.

38. A cross-country ski system according to claim 37, further comprising:

the binding device, said binding device comprising said guide rib.

39. A cross-country ski system according to claim 36, wherein:

the ski includes no baseplate on the ski in the longitudinal central zone.

40. A cross-country ski system according to claim 36, wherein:

the upwardly facing binding-receiving open interruption is structured and arranged to receive a width of the binding device.

* * * * *